United States Patent [19]

Goffe, deceased et al.

[11] 4,081,279

[45] Mar. 28, 1978

[54] PHOTOTHERMOGRAPHIC MATERIALS CONTAINING RADIATION SENSITIVE QUINONE COMPOUNDS AND NITROBENZYLIDENE DYES

[75] Inventors: Charles A. Goffe, deceased, late of Brockport, N.Y., by Patricia Anne Goffe, executrix; Donald W. Heseltine; Robert E. Bernard, both of Rochester, N.Y.

[73] Assignee: Eastman Kodak Company, Rochester, N.Y.

[21] Appl. No.: 689,324

[22] Filed: May 24, 1976

[51] Int. Cl.[2] ..... G03C 5/24; G03C 3/26

[52] U.S. Cl. ..... 96/48 HD; 427/56

[58] Field of Search ..... 96/114.1, 48 HD; 427/56

[56] References Cited

U.S. PATENT DOCUMENTS

| | | | |
|---|---|---|---|
| 3,409,438 | 11/1968 | Lokken | 96/114.1 |
| 3,672,904 | 6/1972 | de Mauriac | 96/114.1 |

FOREIGN PATENT DOCUMENTS

| | | |
|---|---|---|
| 788,279 | 6/1972 | Belgium. |
| 2,402,536 | 8/1974 | Germany. |
| 1,399,751 | 7/1975 | United Kingdom. |

OTHER PUBLICATIONS

Research Discl. (10/74) No. 12617, pp. 12 to 30, Imaging element using photoreductants.

*Primary Examiner*—David Klein
*Assistant Examiner*—Louis Falasco
*Attorney, Agent, or Firm*—Richard E. Knapp

[57] ABSTRACT

Certain radiation sensitive quinone compounds and nitrobenzylidene dyes in photothermographic elements, compositions and processes on exposure to activating radiation, release a species which catalyzes the reduction of silver salt oxidizing agents in the presence of non-light sensitive reducing agents upon heating. The elements, after imagewise exposure, are heated to develop the image.

39 Claims, No Drawings

PHOTOTHERMOGRAPHIC MATERIALS CONTAINING RADIATION SENSITIVE QUINONE COMPOUNDS AND NITROBENZYLIDENE DYES

BACKGROUND OF THE INVENTION

This invention relates to certain radiation sensitive quinone compounds and nitrobenzylidene dyes in photothermographic elements, compositions, and processes which do not require the presence of silver halide to provide a developed image using a reasonably short exposure time. In one of its aspects, it relates to photothermographic elements containing such radiation sensitive compounds and dyes. In another of its aspects, it relates to a photothermographic composition containing such radiation sensitive compounds and dyes. A further aspect relates to a method of developing a latent image in the described photothermographic element by overall heating. The photothermographic elements are useful in the graphic arts.

DESCRIPTION OF THE STATE OF THE ART

It is known in the art to provide photothermographic materials containing silver halide which can be imagewise exposed and heat developed to form photographic line and halftone reproductions. Such photographic materials, after imagewise exposure, are heated overall to provide a developed image in the absence of separate processing solutions. Reducing agents which have been employed with silver halide in photothermographic materials are described, for example, in Belgian Pat. No. 765,452, issued May 28, 1971; Belgian Pat. No. 765,602, issued May 28, 1971; Belgian Pat. No. 765,601, issued May 28, 1971; Belgian Pat. No. 766,590, issued June 15, 1971; Belgian Pat. No. 766,589, issued June 15, 1971; Belgian Pat. No. 772,371, issued Oct. 15, 1971; U.S. Pat. No. 3,152,904 of Sorenson et al., issued Oct. 13, 1964; U.S. Pat. No. 3,152,903 of Sorenson et al., issued Oct. 13, 1964; U.S. Pat. No. 3,457,075 of Morgan et al., issued July 22, 1969; U.S. Pat. No. 3,392,020 of Yutzy et al., issued July 9, 1968 and British Specification No. 1,161,177, published Aug. 20, 1969. It has been desirable to replace photographic silver halide in high contrast films in the prior art. The high expense and shortage of silver has resulted in a continuing search for substitutes. However, at this time, no material has been found to provide the high contrast provided by silver halide at reasonable imagewise exposure times.

One photothermographic material without the silver halide component is described in Lokken U.S. Pat. No. 3,409,438. This photothermographic material contains certain compounds which are reducing agent precursors and forms a developed image after heat development. These photothermographic materials, however, are not capable of forming high contrast images after being exposed for only short periods of time.

Use of certain nitrobenzylidene dyes as impregnates for support materials for photographic elements containing silver halide is described in Belgian Pat. No. 788,279 issued Feb. 28, 1973. A non-silver halide-containing photothermographic element has not been found that is capable of being exposed for a short time and heat developed to a high-contrast image.

*Research Disclosure,* October, 1974, Item 12617, pages 12–30 describes the use of radiation-sensitive quinones to reduce silver salts to form an image. However, as no amplification results from such processes, the resulting image has a low $D_{max}$ and large amounts of quinone are necessary to form a visible image.

Accordingly, there has been a continuing need to provide improved photothermographic elements, compositions and processes that do not contain silver halide to provide images having high contrast between $D_{max}$ and $D_{min}$ with a minimum of exposure time.

SUMMARY OF THE INVENTION

It has been found, according to this invention, that a high contrast image can be obtained using a relatively short exposure in non-silver halide photothermographic elements and/or compositions comprising an energy-sensitive quinone compound or combination of said quinone compounds with energy-sensitive dyes. The energy-sensitive dyes can be employed in a photothermographic material comprising an oxidation-reduction combination comprising a non-silver halide silver salt oxidizing agent and a non-light sensitive reducing agent and a binder. The quinone compounds enable the omission of silver halide from the described photothermographic materials.

DETAILED DESCRIPTION OF THE INVENTION

The photothermographic compositions of this invention comprise the energy-sensitive quinone compound, a silver salt oxidizing agent, a non-light sensitive reducing agent such as bis-beta-naphthol and a binder.

The energy-sensitive quinone compound, which upon exposure to actinic radiation catalyzes the reduction of the silver compound to metallic silver, is a radiation sensitive quinone compound represented by the formula

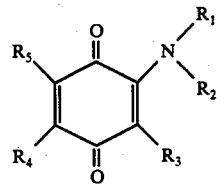

wherein $R_2$ is alkyl containing from 1 to 10 carbon atoms such as methyl, ethyl, propyl, isobutyl pentyl hexyl, octyl, decyl and the like, or aryl containing 6 to 12 carbon atoms such as phenyl, naphthyl, tolyl and the like, or aralkyl containing 6 to 12 carbon atoms such as phenylbutyl, phenylethyl, and the like.

When $R_2$ is alkyl or aralkyl, $R_1$ is alkyl containing from 1 to 10 carbon atoms such as methyl, ethyl, isopropyl, butyl, hexyl, nonyl, decyl and the like, aralkyl containing from 6 to 12 carbon atoms such as phenyl, hexyl, and the like, or aryl containing from 6 to 12 carbon atoms such as phenyl, naphthol, tolyl and the like.

When $R_2$ is aryl, $R_1$ is alkyl containing from 1 to 10 carbon atoms as described above for $R_2$ or alkaryl containing from 6 to 12 carbon atoms such as butylphenyl and the like.

$R_1$ and $R_2$ can, taken together, comprise the atoms necessary to form a heterocyclic ring such as pyrrolidine, piperidine, and the like.

$R_3$ and $R_5$ are independently selected from the group consisting of hydrogen, aryl containing 6 to 12 carbon atoms such as described above for $R_1$, alkyl containing 1 to 10 carbon atoms such as described above for $R_1$, halogen such as chloro, bromo and iodo or alkoxy containing 1 to 6 carbon atoms such as methoxy, ethoxy, propoxy and the like.

$R_4$ is hydrogen,

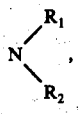

$NHR_2$, alkyl containing 1 to 10 carbon atoms as described above for $R_1$, aryl containing from 6 to 12 carbon atoms such as described above for $R_1$, halogen such as chloro, bromo and iodo or alkoxy containing from 1 to 6 carbon atoms such as methoxy, ethoxy, propoxy and the like wherein $R_1$ and $R_2$ are as described above and $R_4$ and $R_5$ can, taken together, comprise the atoms necessary to complete a carbocyclic ring such as cyclohexane, cyclopentane and the like or an aromatic ring such as benzene or naphthalene and the like.

It is understood that the terms "alkyl" and "aryl" as used throughout the specification include substituted alkyl and aryl substituents such as alkyl and aryl substituted with halogen, nitro, cyano and the like. Any substituent is useful so long as the substituent does not interfere with the imaging process.

Useful quinone compounds which are particularly preferred are:

COMPOUND A 2,5-Dimethylamino-3,6-dimethyl-1,4-benzoquinone

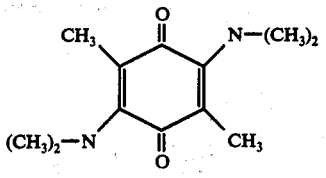

COMPOUND B 2,5-Di-tert-butyl-1,4-benzoquinone

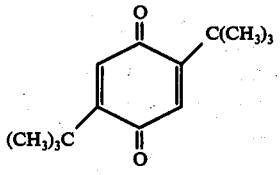

COMPOUND C

2-Chloro-3-dimethylamino-1,4-naphthoquinone

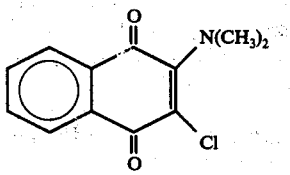

COMPOUND D

2-Dimethylamino-3,6-dimethyl-5-methylamino-1,4-benzoquinone

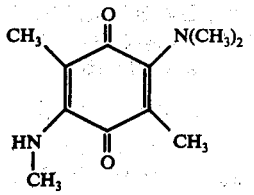

COMPOUND E 2,5-Dimethyl-3,6-bispyrrolidino-1,4-benzoquinone

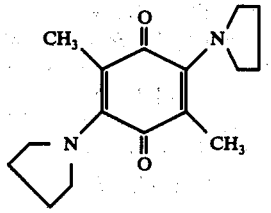

COMPOUND F 2,5-Dimethylamino-1,4-benzoquinone

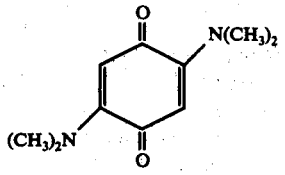

COMPOUND G 2,5-Diethylamino-1,4-benzoquinone

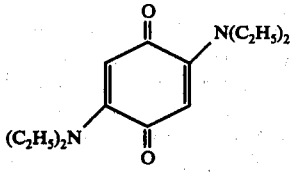

The quinone can be employed as the only energy-sensitive compound or can be used in combination with o-nitro-substituted dyes having the formula:

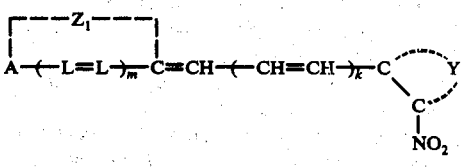

I.

wherein:

(a) $k$ represents 0 or 1;

(b) $m$ represents 0 or 1;

(c) each L represents a methine group, including substituted methine groups, (e.g., —CH=, —C(CH$_3$)=, etc.);

(d) A represents an electron donating moiety, such as oxygen (—O—), sulfur (—S—), or $$-\underset{\underset{R_1}{|}}{N}-;$$

(e) $R_1$ represents (1) an alkyl group having from 1 to 18 carbon atoms and preferably a lower alkyl group having from 1 to 4 carbon atoms (e.g., methyl, ethyl, propyl, isopropyl, butyl, secondary-butyl, isobutyl, tert-butyl, pentyl, hexyl, octyl, decyl, dodecyl, octadecyl); a sulfoalkyl group, preferably sulfo lower alkyl containing from 1 to 4 carbon atoms in the alkyl moiety (e.g., β-sulfoethyl, γ-sulfopropyl, γ-sulfobutyl, δ-sulfobutyl, etc.); a carboxyalkyl group, preferably a carboxy lower alkyl containing from 1 to 4 carbon atoms in the alkyl moiety (e.g., β-carboxyethyl, γ-carboxypropyl δ-carboxybutyl, etc.), a sulfatoalkyl group, preferably a sulfato lower alkyl containing from 1 to 4 carbon atoms in the alkyl moiety (e.g., β-sulfatoethyl, γ-sulfatopropyl, δ-sulfatobutyl, etc.); an alkoxyalkyl group, preferably a lower alkoxy lower alkyl containing from 1 to 4 carbon atoms in both the alkoxy and alkyl moieties (e.g., β-methoxyethyl, γ-methoxypropyl, δ-propoxybutyl, etc.); an acyloxyalkyl group, preferably an acyloxy lower alkyl containing from 1 to 4 carbon atoms in the alkyl moiety (e.g., acetyloxyethyl, propanoyloxyethyl, butanoyloxybutyl, benzoyloxyethyl, toloyloxypropyl, etc.); an alkoxycarbonylalkyl group, preferably a lower alkoxy carbonyl lower alkyl containing 1 to 4 carbon atoms in both the alkoxy and alkyl moieties (e.g., β-methoxycarbonylethyl, δ-ethoxycarbonylbutyl, β-butoxycarbonylethyl, etc.); a dialkylaminoalkylene group, preferably a di-lower alkylamino lower alkylene containing 1 to 4 carbon atoms in the alkylene and alkyl moieties (e.g., dimethylaminoethylene, diethylaminopropylene, diethylaminobutylene, etc.); a cycloaminoalkylene group, preferably cycloamino lower alkyl containing 4 to 6 atoms in the cycloamino moiety and 1 to 4 atoms in the alkyl moiety (e.g., pyrrolidinylethylene, morpholinopropylene, piperidinobutylene, pyrrolinylmethylene, etc.); (2) an alkenyl group (including a substituted alkenyl group), preferably a lower alkenyl containing 2 to 4 carbon atoms (e.g., ethenyl, allyl, 1-propenyl, 1-butenyl, 2-butenyl, etc.), or (3) an aryl group (including a substituted aryl)—e.g., phenyl, naphthyl, tolyl, xylyl, halophenyl such as p-chlorophenyl, p-bromophenyl, etc., alkoxyphenyl such as methoxyphenyl, 2,4-dichlorophenyl, etc. and an aralkyl group, preferably an aryl lower alkyl containing from 1 to 4 carbon atoms in the alkyl moiety (e.g., benzyl, β-phenethyl, ω-phenbutyl, etc.)

(f) Y represents the atoms necessary to complete an aryl (preferably phenyl or naphthyl) ring which is ortho-nitro-substituted and preferably is also para-substituted with a nitro or other electron-withdrawing group such as $$\overset{O}{\overset{\|}{C}}OCH_3$$

and which can have an electron-withdrawing group and which can have other substituents attached to it and other carbocyclic rings fused to it (e.g., 2-nitrophenyl, 2,4-dinitrophenyl, 2,6-dinitrophenyl, 2,4,6-trinitrophenyl, 2-nitronaphthyl, 2,4-dinitronaphthyl, 2-nitro-4-cyanophenyl, 2-nitro-4-ethoxycarbonylphenyl, 2-nitro-4-trifluoro-methylphenyl, and the like); and (g) $Z_1$ represents the non-metallic atoms necessary to complete a heterocyclic nucleus of the type used in cyanine dyes containing 5 or 6 atoms in the heterocyclic ring containing the electron-donating atom of the formula which ring can contain a second hetero atom such as oxygen, nitrogen, selenium or sulfur. The heterocyclic nucleus preferably is selected from the group consisting of a thiazole nucleus including substituted and unsubstituted benzothiazole and naphthothiazole nuclei and like, (e.g., thiazole, 4-methylthiazole, 4-phenylthiazole, 4,5-diphenylthiazole, 4-(2-thienyl)thiazole, benzothiazole, 4-chlorobenzothiazole, 4-methylbenzothiazole, 4-methoxybenzothiazole, 4-ethoxybenzothiazole, 4-phenylbenzothiazole, 5-chlorobenzothiazole, 5-bromobenzothiazole, 5-methylbenzothiazole, 5-methoxybenzothiazole, 5-ethoxybenzothiazole, 5-phenylbenzothiazole, 6-chlorobenzothiazole, 6-bromobenzothiazole, 6-methylbenzothiazole, 6-methoxybenzothiazole, 6-ethoxybenzothiazole, 5-methoxynaphtha[2,3-d]thiazole, β-naphthothiazole, α-naphthothiazole, 5-nitrobenzothiazole, 6-nitrobenzothiazole, 5-chloro-6-nitrobenzothiazole, etc.); an oxazole nucleus including substituted and unsubstituted benzoxazole and naphthoxazole nuclei and the like, (e.g., oxazole, 4-phenyloxazole, benzoxazole, 5-chlorobenzoxazole, 5-methylbenzoxazole, 5-bromobenzoxazole, 5-methoxybenzoxazole, 5-ethoxybenzoxazole, 5-phenylbenzoxazole, 5-methoxynaphthoxazole, 5-nitrobenzoxazole, 6-nitrobenzoxazole, 5-chloro-6-nitrobenzoxazole, etc.); a selenazole nucleus including substituted and unsubstituted benzoselenazole and naphthoselenazole nuclei and the like, (e.g., selenazole, 4-methylselenazole, 4-nitroselenazole, 4-phenylselenazole, benzoselenazole, 5-chlorobenzoselenazole, 6-chlorobenzoselenazole, naphtho[2,1-d]selenazole, 5-nitrobenzoselenazole, 6-nitrobenzoselenazole, 5-chloro-6-nitrobenzoselenazole, nitro group-substituted naphthoselenazoles, etc.); a thiazoline nucleus, (e.g., thiazoline, 4-methylthiazoline, 4-nitrothiazoline, etc.); a 2-pyridine nucleus, (e.g., 2-pyridine, 5-methyl-2-pyridine, etc.); a 4-pyridine nucleus, (e.g., 4-pyridine, 3-methyl-4-pyridine, nitro group-substituted pyridines, etc.); a 3,3-dialkyl-indolenine nucleus (e.g., 3,3-dimethylindolenine, 3,3-diethyl-5 or 6-cyanoindolenine, 3,3-diethyl-5 or 6-nitroindolenine, 3,3-dimethyl-5 or 6-nitroindolenine, etc.); an imidazole nucleus, (e.g., imidazole, 1-alkylimidazole, benzimidazole, 1,3-dialkyl, 1,3-diaryl or 1-alkyl-3-arylimidazoles and benzimidazoles, such as 5-chloro-1,3-dialkylbenzimidazoles, 5-chloro-1,3-diarylbenzimidazoles, 5,6-dichloro-1,3-diarylbenzimidazoles, 5-methoxy-1,3-dialkylbenzimidazoles, 5-methoxy-1,3-diarylbenzimidazoles, 5-cyano-1,3-dialkylbenzimidazoles, 5-cyano-1,3-diarylbenzimidazoles, 1,3-dialkylnaphth[1,2-d]imidazole, 1,3-diarylnaphth[2,1-d]imidazole, etc.); a quinoline nucleus, (e.g., quinoline, 6-methylquinoline, 6-methoxyquinoline, 6-ethoxyquinoline, 6-chloroquinoline, 4-methoxyquinoline, 4-methylquinoline, 8-methoxyquinoline, β-methylquinoline, 4-chloroquinoline, 6-nitroquinoline, etc.); an imidazo[4,5-*b*]quinoxaline nucleus (as described in Brooker and Van Lare, U.S. Pat. No. 3,431,111), (e.g., imidazo[4,5-*b*]quinoxaline, 1,3-dialkylimidazo[4,5-*b*]-quinoxaline such as 1,3-diethylimidazo[4,5-*b*]quinoxaline, 6-chloro-1,3-diethylimidazo[4,5-*b*]quinoxaline, etc., 1,3-dialkenylimidazo[4,5-*b*]quinoxaline such as 1,3-diallylimidazo[4,5-*b*]quinoxaline, 6-chloro-1,3-diallylimidazo[4,5-*b*]quinoxaline, etc., 1,3-diarylimidazo[4,5-*b*]quinoxaline such as 1,3-diphenylimidazo[4,5-*b*]quinoxaline, 6-chloro-1,3-diphenylimidazo[4,5-*b*]quinoxaline, etc.); a 3H-pyrrolo[2,3-*b*]pyridine nucleus, e.g., 3,3-dialkyl-3H-pyrrolo[2,3-*b*]pyridine such as 3,3-dimethyl-3H-pyrrolo[2,3-*b*]pyridine, 3,3-diethyl-3H-pyrrolo[2,3-*b*]pyridine, 1,3,3-trialkyl-3H-pyrrolo[2,3-*b*]pyridine such as 1,3,3-triethyl-3H-pyrrolo[2,3-*b*]pyridine, etc.); and a thiazolo[4,5-*b*]quinoline nucleus; a pyrylium (including benzopyrylium, thiapyrylium and benzothiapyrylium) nucleus; and a dithiolinium nucleus. In the most preferred embodiment $Z_1$ represents the atoms necessary to form a pyridine or quinoline nucleus.

The above dyes, wherein *k* represents 0, preferably are prepared by reacting a heterocyclic salt of the formula:

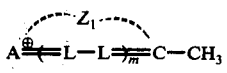

II.

with a nitro-substituted compound having the formula:

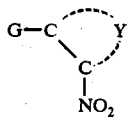

III.

In the above formulae II and III, *m, n,* A, $Z_1$, L, and Y have the same meaning as defined above, G represents a halide such as fluoride, chloride or bromide, and X represents an acid anion (e.g., halide such as chloride, bromide, or iodide, p-toluenesulfonate, thiocyanate, sulfamate, perchlorate fluoroborate, methylsulfonate, ethylsulfonate, fluorosulfonate, 2,4-dinitrobenzenesulfonate, etc.).

The preparation of dyes according to the description above is fully set out in Belgian Pat. No. 788,279 issued Feb. 28, 1973.

Examples of o-nitro-substituted dyes useful with the quinone compounds which can be used in lieu of the conventional silver halide catalyst are:

2-(2,4-Dinitrobenzylidene)-3-ethylbenzothiazoline

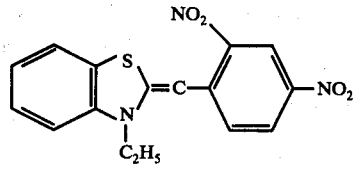

2-(2,4-Dinitrobenzylidene)-1,3-diethyl-1,2-dihydroimidazo[4,5-*b*]quinoxaline

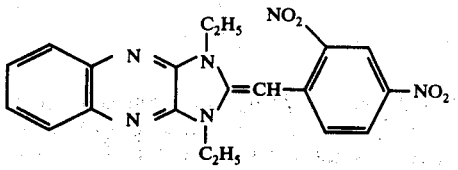

2-(2,4-Dinitrobenzylidene)-3-ethyl-2,3-dihydrothiazolo[4,5-*b*]quinoline

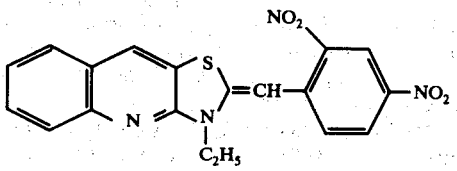

2-(2,4-Dinitrobenzylidene)-1,3,3-trimethylindoline

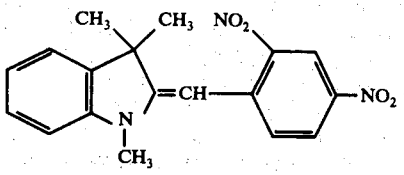

4-(2,4-Dinitrobenzylidene)-1-ethyl-1,4-dihydroquinoline

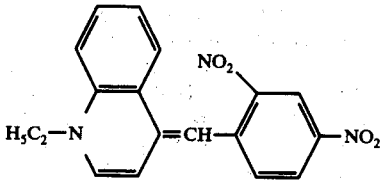

2-(2,4-Dinitrobenzylidene)-1,2-dihydro-1-(3-sulfopropyl)quinoline, sodium salt

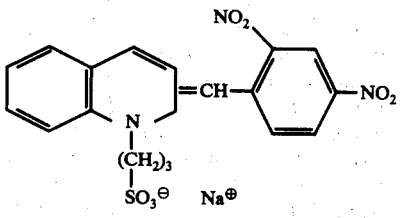

4-(2,4-Dinitrobenzylidene)-1,2-dihydro-1-(4-sulfobutyl)quinoline, sodium salt

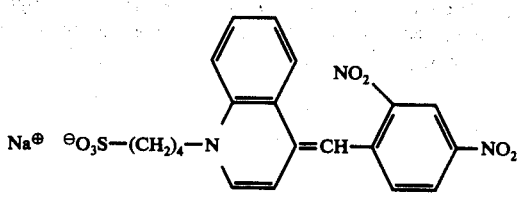

1,4-Dihydro-4-(2,4-dinitrobenzylidene)-1-octadecylquinoline

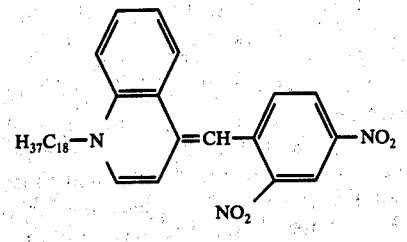

The preferred energy-sensitive composition is a combination of a quinone compound and nitro-substituted dye. The quinone compound should comprise from about 1 to about 100 weight percent of the combination. In the most preferred embodiment, the quinone dye and nitro substituted dye are present in equal molar amounts.

The quinone which provides the most useful results when used with the ortho-nitro-substituted arylidene dyes has the formula:

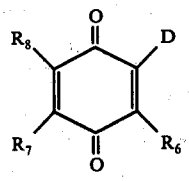

wherein D is selected from the group consisting of alkyl preferably containing 1 to 10 carbon atoms such as methyl, ethyl, propyl, isobutyl and the like and

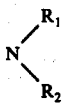

wherein $R_1$ and $R_2$ are as described above.

$R_6$ and $R_8$ are independently selected from the group consisting of hydrogen, alkyl preferably containing from 1 to 10 carbon atoms, aryl preferably containing from 6 to 12 carbon atoms, halogen, such as chloro, bromo and iodo and alkoxy preferably containing from 1 to 6 carbon atoms such as methoxy, butoxy and the like.

$R_7$ is hydrogen, halogen, such as chloro, bromo and iodo, alkyl preferably containing from 1 to 10 carbon atoms, aryl preferably containing from 6 to 12 carbon atoms, alkoxy preferably containing from 1 to 6 carbon atoms and $NHR_2$ and

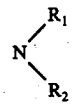

wherein $R_1$ and $R_2$ are as described above.

The quinone, if used without the nitro-substituted arylidene dye, is generally present in a small quantity and preferably a molar ratio of $10^{-2}$ to $10^{-4}$ mole of quinone to total silver in the photothermographic material.

One embodiment of the invention is: in a non-silver halide photothermographic element comprising a support having thereon a catalyst, an oxidation-reduction image-forming combination comprising a heavy metal salt oxidizing agent with a non-light sensitive reducing agent, and a binder; the improvement comprising the above-mentioned compounds as the catalyst instead of the conventional silver halide catalyst.

The combination of compounds is generally present in the photothermographic composition at a concentration range from about $10^{-1}$ mole/mole of total silver to about $10^{-5}$ mole/mole of total silver in the silver salt oxidizing agent and preferably at a concentration ranging from about $10^{-2}$ to about $10^{-4}$ mole/mole silver.

The photothermographic elements and compositions according to the invention comprise an oxidation-reduction image-forming combination which contains an oxidizing agent, preferably a heavy metal salt oxidizing agent. The heavy metal salt oxidizing agent can be a heavy metal salt of an organic acid such as a fatty acid which is resistant to darkening upon illumination. An especially useful class of heavy metal salts of organic acids is represented by the water insoluble silver salts of long-chain fatty acids which are stable to light. Compounds which are suitable silver salt oxidizing agents include silver behenate, silver stearate, silver oleate, silver laurate, silver hydroxystearate, silver caprate, silver myristate and silver palmitate. Silver salts can be employed as the heavy metal salt oxidizing agent which are not silver salts of long chain fatty acids. Such silver salt oxidizing agents which are useful include, for example, silver benzoate, silver benzotriazole, silver terephthalate, silver phthalate and the like.

A range of non-energy-sensitive reducing agents such as bis-naphthol reducing agents can be employed in the practice of the invention to provide a desired developed image. These can be employed in combination, if desired, with other reducing agents. Suitable organic reducing agents which can be employed in the described combination include, for example, substituted phenols and naphthols. Bis-naphthol reducing agents are described, for example, in U.S. Pat. No. 3,672,904 of deMauriac issued June 27, 1972.

The bis-naphthol which is preferred is a bis-beta-naphthol of the formula:

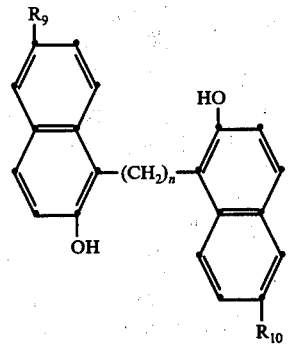

wherein $R_9$ and/or $R_{10}$ is hydrogen, alkyl with 1 to 3 carbon atoms, alkoxy, e.g. alkoxy containing 1 to 2 carbon atoms, such as methoxy or ethoxy; halogen, nitro, amino, or a diazonium halide salt and $n$ is 0 or 1.

An especially suitable bis-$\beta$-naphthol is 1,1'-bi-2-naphthol of the formula:

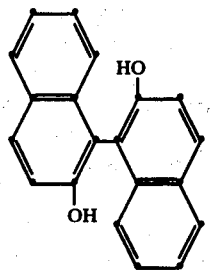

Other examples of suitable bis-β-naphthols which can be employed in the practice of the invention include:

6,6'-dibromo-2,2'-dihydroxy-1,1'-binaphthyl 6,6'-dinitro-2,2'-dihydroxy-1,1'-binaphthyl bis-2-hydroxy-1-methane.

The described non-energy sensitive reducing agents are suitable in a range of concentration; however, they are especially suitable, at a concentration from about 0.1 to 0.75 mole of reducing agent per mole of silver in an element as described.

Other non-light sensitive reducing agents can be used in lieu of or in conjunction with the above bis-naphthol reducing agents. These include, for example, polyhydroxybenzenes such as hydroquinone developing agents, e.g., hydroquinone, alkyl-substituted hydroquinones as exemplified by tertiary butylhydroquinone, methylhydroquinone, 2,5-dimethylhydroquinone and 2,6-dimethylhydroquinone; catechols and pyrogallol; halo-substituted hydroquinones such as chlorohydroquinone or dichlorohydroquinone; alkoxy-substituted hydroquinones such as methoxyhydroquinone or ethoxyhydroquinone; methoxynaphthalene; phenylenediamine developing agents; methylgallate; aminophenol developing agents, such as 2,4-diaminophenols and methylaminophenols; ascorbic acid developing agents such as ascorbic acid, ascorbic acid ketals and ascorbic acid derivatives such as those described in U.S. Pat. No. 3,337,342 of Green issued Aug. 22, 1967; hydroxylamine developing agents such as N,N'-di(2-ethoxyethyl)hydroxylamine; 3-pyrazolidone developing agents such as 1-phenyl-3-pyrazolidones and 4-methyl-4-hydroxymethyl-1-phenyl-3-pyrazolidone including those described in British Pat. No. 930,572 published July 3, 1963; hydroxytetronic acid, and hydroxytetronimide developing agents; reductone developing agents such as anhydrodihydropyrrolidino hexose reductone; and sulfonamidophenol reducing agents such as described in Evans and McLaen U.S. Pat. No. 3,801,321 issued Apr. 2, 1974 and the like.

The photothermographic element and composition can contain various colloids alone or in combination as binders. Suitable materials are typically hydrophobic but hydrophilic materials can also be employed. They are transparent or translucent and include both naturally-occurring substances such as proteins, for example, gelatin, gelatin derivatives, cellulose derivatives, polysaccharides such as dextran, gum arabic and the like; and synthetic polymeric substances such as water-soluble polyvinyl compounds like poly(vinyl pyrrolidone), acrylamide polymers and the like. Other synthetic polymeric compounds which can be employed include dispersed vinyl compounds such as in latex form and particularly those which increase dimensional stability of photographic materials. Suitable synthetic polymers include those described in U.S. Pat. No. 3,142,568 of Nottorf issued July 28, 1964; U.S. Pat. No. 3,193,386 of White issued July 6, 1955; U.S. Pat. No. 3,062,674 of Houck et al issued Nov. 6, 1962; U.S. Pat. No. 3,220,844 of Houck et al issued Nov. 30, 1965; U.S. Pat. No. 3,287,289 of Ream et al issued Nov. 22, 1966 and U.S. Pat. No. 3,411,911 of Dykstra issued Nov. 19, 1968. Effective polymers include water insoluble polymers of alkyl acrylates and methacrylates, acrylic acid, sulfoalkyl acrylates or methacrylates, and those which have crosslinking sites which facilitate hardening or curing as well as those having recurring sulfobetaine units as described in Canadian Pat. No. 774,054. Preferred high molecular weight materials and resins include poly(vinyl butyral), cellulose acetate butyrate, polymethyl methacrylate, poly(vinyl pyrrolidone), ethyl cellulose, polystyrene, polyvinyl chloride, chlorinated rubber, polyisobutylene, butadiene-styrene copolymers, vinyl chloride-vinyl acetate copolymers, copolymers of vinyl acetate, vinyl chloride and maleic acid, polyvinyl alcohol, and high molecular weight ethylene oxide polymers.

It is often desirable to employ a so-called activator toning agent, also known as an accelerator-toning agent, in the photothermographic elements according to the invention to obtain a desired image. The activator toning agent is typically useful in a range of concentration, such as a concentration of about 0.10 moles to about 1.1 moles of activator toning agent per mole of oxidizing agent in the photothermographic element. A typical suitable activator toning agent is a heterocyclic activator toning agent containing at least one nitrogen atom as described, for example, in Belgian Pat. No. 766,590 issued June 15, 1971 and U.S. Pat. No. 3,846,136 of Sullivan issued Nov. 5, 1974. Typical activator toning agents include, for example, cyclic imides, such as phthalimide, N-hydroxyphthalimide, N-hydroxy-1,8-naphthalimide, N-potassium phthalimide, N-mercury phthalimide, succinimide and/or N-hydroxysuccinimide. Other activator toning agents which can be employed include phthalazinone, 2-acetylphthalazinone and the like.

An especially useful photothermographic element that according to the invention comprises a support having thereon (a) an oxidation-reduction image-forming combination comprising i) 1,1'-bi-2-naphthol and ii) silver behenate, (b) a poly(vinyl butyral) binder, (c) phthalimide, and (d) 2,5-dimethylamino-3,6-dimethyl-1,4-benzoquinone or a combination of the 2,5-dimethylamino-3,6-dimethyl-1,4-benzoquinone and 4-(2,4-dinitrobenzylidene)-1-ethyl-1,4-dihydroquinoline.

Photothermographic elements according to the invention can contain hardeners, antistatic layers, development modifiers that function as speed-increasing compounds, plasticizers and lubricants, coating aids, brighteners, absorbing and filter dyes, also as described in *Product Licensing Index*, Vol. 92, December, 1971, publication 9232, pages 107–110, paragraph I, as well as incorporated developers such as described in U.S. Pat. No. 3,672,904 issued June 27, 1972, and antihalation dyes such as described in Belgian Pat. No. 732,863.

The photothermographic elements according to the invention can comprise a wide variety of supports. Typical supports include cellulose nitrate film, cellulose ester film, poly(vinyl acetal) film, polystyrene film, poly(ethylene terephthalate) film, polycarbonate film and related films or resinous materials, as well as glass, paper, metal and the like supports which can withstand the processing temperatures employed according to the invention. Typically a flexible support is employed.

Another embodiment of the invention is a photothermographic composition comprising (a) an oxidation-reduction image-forming combination comprising (i) a silver salt oxidizing agent with (ii) a bis-beta-naphthol reducing agent; (b) a binder as described such as poly(vinyl butyral); and (c) an energy-sensitive quinone or combination of quinone and o-nitro-substituted arylidene dye as described.

It is noted that developed images in color can be produced by the addition to the photothermographic composition of a color-forming coupler and a base release agent such as described in deMauriac et al., U.S. Pat. No. 3,761,270 issued Sept. 25, 1973. The compositions can also be physically developed as described in British Pat. No. 1,131,238 issued Oct. 23, 1968.

The photothermographic composition and other compositions according to the invention can be coated on a suitable support by various coating procedures including dip coating, air knife coating, curtain coating or extrusion coating using hoppers such as described in U.S. Pat. No. 2,681,294 of Begiun issued June 15, 1954. If desired, two or more layers can be coated simultaneously such as described in U.S. Pat. No. 2,761,791 of Russell issued Sept. 4, 1956 and British Pat. No. 837,095.

Ultraviolet-absorbing dyes can be used in the described photothermographic elements and compositions of the invention to confer additional sensitivity to the elements and compositions of the invention. Useful ultraviolet-absorbing dyes are described, for example, in *Product Licensing Index,* Vol. 92, December, 1971, publication 9232, pp. 107–110. Useful ultraviolet-absorbing dyes are present in the photothermographic element or composition in coverages ranging from about 0.1 mg./929 cm.$^2$ to about 20.0 mg./929 cm.$^2$.

After exposure of the described photothermographic element according to the invention, typically to visible light, the resulting latent image can be developed merely by overall heating the element to moderately elevated temperatures. This merely involves heating the described photothermographic element overall from about 80° C to about 250° C such as for about 0.5 seconds to about 60 seconds. By increasing or decreasing the length of time of heating, a higher or lower temperature within the described range can be employed depending upon the desired image. A developed image is typically produced within several seconds, such as about 0.5 seconds to about 60 seconds. A processing temperature of about 110° C to about 165° C is especially useful.

Any suitable means can be used for providing the desired processing temperature range. The heating means can be a simple hot plate, iron, roller or the like.

Processing is usually carried out under ambient conditions of pressure and humidity. Conditions outside normal atmospheric pressures and humidity can be employed if desired.

If desired, the photothermographic element of this invention can be simultaneously exposed and heat processed to development.

The energy-sensitive compounds according to this invention can be combined in the same layer as the image-forming materials and they can be contained in a layer directly adjacent to the photothermographic composition.

Although the photothermographic composition and elements of this invention do not require the presence of silver halide, small amounts of silver halide can be added without deleteriously affecting the image.

The following examples are included for a further understanding of the invention.

EXAMPLE 1

Examples 1 – 15

A series of photothermographic elements were prepared as follows:

Silver behenate dispersion A was prepared by ball-milling the following composition for about 72 hours:

| | |
|---|---|
| Silver behenate | 168 grams |
| polyvinyl butyral | 120 grams |
| acetone-toluene (1:1 parts by volume) | 1600 ml. |

The photothermographic elements were prepared by coating the following composition on a photothermographic paper support at a wet thickness of 0.004 inch.

| | |
|---|---|
| silver behenate dispersion A | 11.4 ml. |
| 1,1'-Bi-2-naphthol (6.3% in acetone) | 4.3 ml. |
| phthalimide (5.0% by weight in acetone) | 4.3 ml. |

The photothermographic elements of this invention were prepared by adding 5.0 mg. of a mixture of substituted arylene dye and/or 5.0 mg. of a quinone compound to the photothermographic composition as described above.

Samples of the photothermographic elements containing compounds according to this invention were imagewise exposed to a high intensity xenon arc flash for $10^{-3}$ seconds and heat processed for about 15 seconds on a curved hot block at a temperature of about 120° C. The results are shown in Table 1.

TABLE I

| Example | nitro-substituted dye | quinone compound | minimum density | maximum density | *relative speed | visible steps |
|---|---|---|---|---|---|---|
| Control A | — | — | 0.31 | 0.39 | — | — |
| 1 | — | A* | 0.37 | 1.61 | 126 | 7 |
| Control B | — | B* | 0.30 | 0.35 | — | — |
| 2 | — | C* | 0.34 | 1.62 | 105 | 6 |
| 3 | — | D* | 0.32 | 1.33 | 27.5 | 5 |
| 4 | — | E* | 0.35 | 1.62 | 80.0 | 5 |
| 5 | — | F* | 0.27 | 0.76 | 12.3 | 4 |
| 6 | — | G* | 0.32 | 1.56 | 94 | 6 |
| 7 | I* | A | 0.40 | 1.66 | 550 | 8 |
| 8 | I | B | 0.41 | 1.60 | 282 | 8 |
| 9 | I | C | 0.53 | 1.71 | 229 | 8 |
| 10 | I | D | 0.45 | 1.63 | 200 | 7 |
| 11 | I | E | 0.37 | 1.66 | 186 | 8 |
| 12 | I | F | 0.36 | 1.62 | 276 | 7 |

TABLE I-continued

| Example | nitro-substituted dye | quinone compound | minimum density | maximum density | *relative speed | visible steps |
|---|---|---|---|---|---|---|
| 13 | I | G | 0.39 | 1.66 | 240 | 8 |
| 14 | II* | A | 0.46 | 1.65 | 234 | 8 |
| 15 | III* | A | 0.46 | 1.64 | 148 | 7 |

*Relative speed was measured at 0.20 above $D_{min}$.

DYE I-

4-(2,4-Dinitrobenzylidene)-1-ethyl-1,4-dihydroquinoline

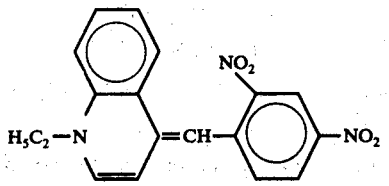

DYE II- 4-(2,4-Dinitrobenzylidene)-1,4-dihydro-1-phenacylquinoline

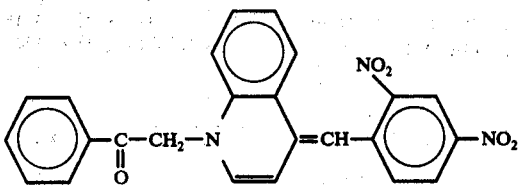

DYE III- 4-(4-Ethoxycarbonyl-2-nitrobenzylidene)-1-ethyl-1,4-dihydroquinoline

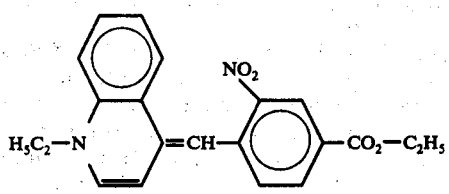

QUINONE A-

2,5-Dimethylamino-3,6-dimethyl-1,4-benzoquinone

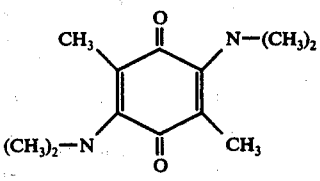

QUINONE B-

2,5-Di-tert-butyl-1,4-benzoquinone

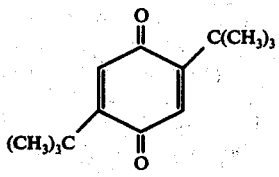

QUINONE C-

2-Chloro-3-dimethylamino-1,4-naphthoquinone

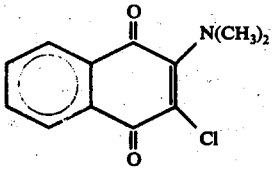

QUINONE D-

2-Dimethylamino-3,6-dimethyl-5-methylamino-1,4-benzoquinone

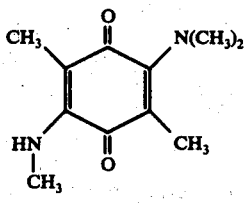

QUINONE E-

2,5-Dimethyl-3,6-bispyrrolidino-1,4-benzoquinone

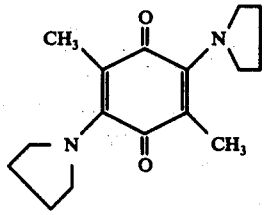

QUINONE F-

2,5-Dimethylamino-1,4-benzoquinone

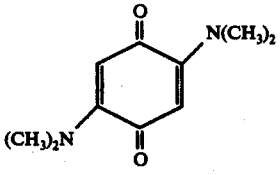

QUINONE G-

2,5-Diethylamino-1,4-benzoquinone

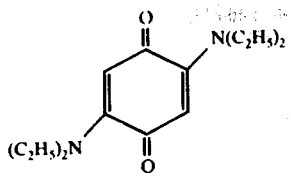

EXAMPLE 16

The speed of the photographic element containing the quinone compounds according to this invention is shown to be unexpectedly superior to the speed of photographic elements containing benzoquinones as described in Lokken U.S. Pat. No. 3,409,438 as follows:

Three solutions were prepared as follows:

| | | |
|---|---|---|
| Solution 1 | | |
| silver pivalate | 208 | mg. |
| xylene | 50 | ml. |
| Solution 2 | | |
| 2,2'-dihydroxy-1,1'-binaphthyl | 286 | mg. |
| poly(vinyl butyral) | 200 | mg. |
| phthalimide | 73.6 | mg. |
| xylene | 50 | ml. |

Solution 3

$1.0 \times 10^{-3}$ molar xylene solution of the quinone tested.

Solutions 1 and 2 were combined in a test tube wrapped with foil to exclude room light. Solution 3 was placed in a 1 ml. quartz spectrophotometric cell (0.35 ml.) and irradiated with a 75 watt bulb fitted with a UV cutoff filter. After irradiation, solution 3 (50 mμ) was added to the combined mixture of solutions 1 and 2 and the resulting solution was heated in the dark for 10 minutes at 60° C. A spectrum of the solution was run to determine silver density and the required time for each solution to reach a density of at least 2.0 was recorded. Table 2 shows the results.

TABLE 2

| Example | Quinone | Exposure Time Required to Reach Density 2.0 |
|---|---|---|
| 16 | A (as described above) | 1–2 sec. |
| Control C 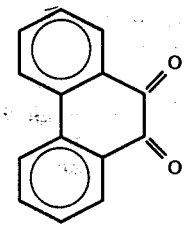 | phenanthrenequinone | 1–2 min. |
| Control D 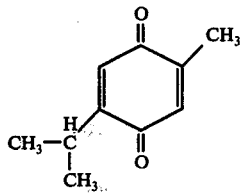 | 2-methyl-5-isopropyl-1,4-benzoquinone | 10–20 min. |
| Control E 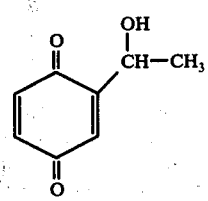 | 2-(α-hydroxyethyl)-1,4-benzoquinone | no reduction after 24 min. |
| Control F 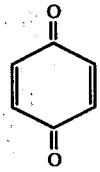 | p-benzoquinone | no reduction after 16 min. |
| Control G $C_6H_5OCCH_2Cl$ | phenylchloroacetate | no reduction after 16 min. |

TABLE 2-continued

| Example | Quinone | Exposure Time Required to Reach Density 2.0 |
|---|---|---|
| Control H | 1,4-naphthoquinone | no reduction after 16 min. |
| Control I | 2,5-dimethyl-1,4-benzoquinone | no reduction after 16 min. |

The invention has been described in detail with particular reference to certain preferred embodiments thereof, but it will be understood that variations and modifications can be effected within the spirit and scope of the invention.

We claim:

1. A non-silver halide photothermographic element comprising a support having thereon a layer comprising a radiation sensitive organic compound composition comprising (1) a radiation sensitive dye represented by the formula

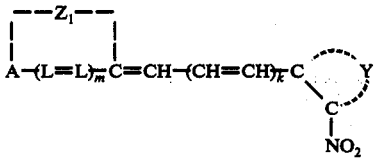

wherein:

(a) k represents 0 or 1;
(b) m represents 0 or 1;
(c) each L represents a methine group;
(d) A represents oxygen, sulfur or N-$R_1$;
(e) $R_1$ represents alkyl, alkenyl or aryl;
(f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms, and
(g) Y represents the atoms necessary to complete a nitro-substituted phenyl or naphthyl group or a carbonyl-substituted phenyl naphthyl group; with (2) a radiation sensitive quinone compound represented by the formula:

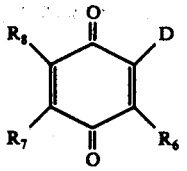

wherein D is selected from the group consisting of alkyl and

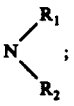

$R_1$ alkyl, aryl, or aralkyl; $R_2$ is alkyl, aralkyl, or aryl and $R_1$ and $R_2$ can, taken together, represent the atoms necessary to form a heterocyclic ring; $R_6$ is hydrogen, alkyl, aryl, halogen, or alkoxy; $R_7$ is $NHR_2$ or

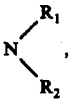

alkyl, aryl, hydrogen, halogen or alkoxy and $R_8$ is hydrogen, alkyl, aryl, halogen or alkoxy and wherein $R_7$ and $R_8$ can, taken together, represent the atoms necessary to form a carbocylic ring; and in the same layer or in an adjacent layer (a) an organic acid silver salt oxidizing agent,
(b) a non-radiation sensitive reducing agent, and
(c) a binder for said layer.

2. A non-silver halide photothermographic element as in claim 1 wherein said quinone compound is a compound selected from the group consisting of 2-chloro-3-dimethylamino-1,4-naphthoquinone; 2-dimethylamino-3,6-dimethyl-5-methylamino-1,4-benzoquinone; 2,5-dimethyl-3,6-bispyrrolidino-1,4-benzoquinone; 2,5-dimethylamino-1,4-benzoquinone; 2,5-diethylamino-1,4-benzoquinone; 2,5-di-tert-butyl-1,4-benzoquinone and combinations thereof.

3. A non-silver halide photothermographic element as in claim 1 wherein said silver salt is a silver salt of a long chain fatty acid.

4. A non-silver halide photothermographic element as in claim 3 wherein said silver salt is silver behenate.

5. A non-silver halide photothermographic element as in claim 1 wherein said non-radiation sensitive reducing agent is a bis-beta naphthol.

6. A non-silver halide photothermographic element as in claim 5 wherein said bis-beta naphthol is 1,1'-bi-2-naphthol.

7. A non-silver halide photothermographic element as in claim 1 also comprising an activator-toning agent.

8. A non-silver halide photothermographic element as in claim 1 also comprising an activator-toning agent comprising phthalimide, succinimide or 1-(2H)-phthalazinone.

9. A non-silver halide element as in claim 1 wherein said layer comprises about 0.01 mg to about 1.10 mg per $dm^2$ of support of said dye 1 and about 0.01 mg. to about 1.10 mg per $dm^2$ of support of said quinone 2.

10. A non-silver halide photothermographic composition comprising (a) a radiation sensitive organic compound composition comprising (1) a radiation sensitive dye represented by the formula:

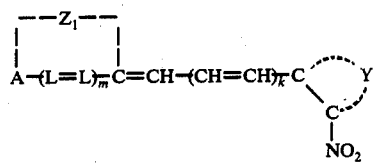

wherein:

(a) k represents 0 or 1;

(b) m represents 0 or 1;

(c) each L represents a methine group;

(d) A represents oxygen, sulfur or N-$R_1$;

(e) $R_1$ represents alkyl, alkenyl or aryl;

(f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms, and (g) Y represents the atoms necessary to complete a nitro-substituted phenyl or naphthyl group or a carbonyl-substituted phenyl or naphthyl group; with (2) a radiation sensitive quinone compound represented by the formula:

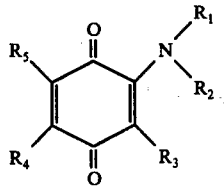

wherein when $R_2$ is alkyl or aralkyl, $R_1$ is alkyl containing 1 to 10 carbon atoms, aralkyl containing 6 to 12 carbon atoms, or aryl containing 6 to 12 carbon atoms;

when $R_2$ is aryl, $R_1$ is alkyl containing 1 to 10 carbon atoms or alkaryl containing 6 to 12 carbon atoms;

$R_2$ is alkyl containing 1 to 10 carbon atoms, aryl containing 6 to 12 carbon atoms, or aralkyl containing 6 to 12 carbon atoms;

$R_1$ and $R_2$ can comprise the atoms necessary to complete a heterocyclic ring;

$R_3$ and $R_5$ are independently selected from the group consisting of hydrogen, aryl containing 6 to 12 carbon atoms, alkyl containing 1 to 10 carbon atoms, halogen or alkoxy containing 1 to 6 carbon atoms;

$R_4$ is hydrogen, $NHR_2$

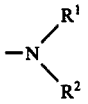

alkyl containing from 1 to 10 carbon atoms, aryl containing 6 to 12 carbon atoms, halogen, or alkoxy containing from 1 to 6 carbon atoms wherein $R^1$ and $R^2$ are as defined; and $R_4$ and $R_5$ can, taken together, comprise the atoms necessary to complete a carbocyclic ring;

(b) an organic acid silver salt oxidizing agent;

(c) a non-radiation sensitive reducing agent; and (d) a polymeric binder.

11. A non-silver halide photothermographic composition as in claim 10 wherein said dye (1) is a compound selected from the group consisting of 4-(2,4-dinitrobenzylidene)-1-ethyl-1,4-dihydroquinoline; 4-(2,4-dinitrobenzylidene)-1,4-dihydro-1-phenacylquinoline; 4-(4-ethoxycarbonyl-2-nitrobenzylidene)-1-ethyl-1,4-dihydroquinoline and combinations thereof.

12. A non-silver halide photothermographic composition as in claim 10 wherein said quinone compound is a compound selected from the group consisting of 2-chloro-3-dimethylamino-1,4-naphthoquinone; 2-dimethylamino-3,6-dimethyl-5-methylamino-1,4-benzoquinone; 2,5-dimethyl-3,6-bispyrrolidino-1,4-benzoquinone; 2,5-dimethylamino-1,4-benzoquinone; 2,5-diethylamino-1,4-benzoquinone and combinations thereof.

13. A non-silver halide photothermographic composition as in claim 10 wherein said silver salt is a silver salt of a long chain fatty acid.

14. A non-silver halide photothermographic composition as in claim 10 wherein said silver salt comprises silver behenate.

15. A non-silver halide photothermographic composition as in claim 10 also comprising an activator-toning agent.

16. A non-silver halide photothermographic composition as in claim 10 also comprising an activator-toning agent comprising phthalimide, succinimide or 1-(2H)-phthalazinone.

17. A non-silver halide photothermographic composition comprising (a) a combination of (1) 4-(2,4-dinitrobenzylidene)-1-ethyl-1,4-dihydroquinoline with (2) 2,5-dimethylamino-3,6-dimethyl-1,4-benzoquinone, (b) silver behenate, (c) an activator-toning agent which is phthalimide or phthalazinone,
(d) a non-radiation sensitive reducing agent for said silver behenate, and
(e) a poly(vinyl butyral) binder.

18. A non-silver halide photothermographic element comprising a support having thereon a layer comprising a radiation sensitive organic compound composition comprising
(a) a radiation sensitive quinone compound represented by the formula

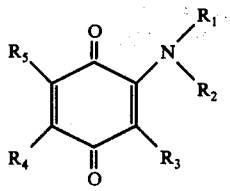

wherein
when $R_2$ is alkyl or aralkyl, $R_1$ is alkyl containing 1 to 10 carbon atoms, aralkyl containing 6 to 12 carbon atoms, or aryl containing 6 to 12 carbon atoms;
when $R_2$ is aryl, $R_1$ is alkyl containing 1 to 10 carbon atoms or alkaryl containing 6 to 12 carbon atoms;
$R_2$ is alkyl containing 1 to 10 carbon atoms, aryl containing 6 to 12 carbon atoms, or aralkyl containing 6 to 12 carbon atoms;
$R_1$ and $R_2$ can, taken together, comprise the atoms necessary to complete a heterocyclic ring;
$R_3$ is hydrogen, aryl containing 6 to 12 carbon atoms, alkyl containing 1 to 10 carbon atoms, halogen, or alkoxy containing 1 to 6 carbon atoms;
$R_4$ is hydrogen, alkyl, aryl, halogen, alkoxy, $NHR_2$ or

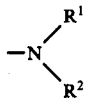

wherein $R^1$ and $R^2$ are as defined;
$R_5$ is hydrogen, alkyl, aryl, halogen or alkoxy and wherein $R^4$ and $R^5$ can, taken together, represent the atoms necessary to form a carbocyclic ring;
(b) a silver salt of a long chain fatty acid,
(c) a non-radiation sensitive reducing agent, and
(d) a polymeric binder for said layer.

19. A non-silver halide photothermographic element as in claim 18 wherein said quinone compound is a compound selected from the group consisting of 2-chloro-3-dimethylamino-1,4-naphthoquinone; 2-dimethylamino-3,6-dimethyl-5-methylamino-1,4-benzoquinone; 2,5-dimethyl-3,6-bispyrrolidino-1,4benzoquinone; 2,5-dimethylamino-1,4-benzoquinone; 2,5-diethylamino-1,4-benzoquinone and combinations thereof.

20. A non-silver halide photothermographic element as in claim 18 wherein said silver salt comprises silver behenate.

21. A non-silver halide photothermographic element as in claim 18 also comprising an activator-toning agent.

22. A non-silver halide photothermographic element as in claim 18 also comprising an activator-toning agent comprising phthalimide, succinimide or 1-(2H)-phthalazinone.

23. A non-silver halide photothermographic element as in claim 18 comprising a support having thereon a layer comprising about 0.01 mg to about 1.10 mg per $dm^2$ of support of said quinone.

24. A non-silver halide photothermographic element comprising a support having thereon a layer comprising a radiation sensitive organic compound composition comprising
(a) 2,5-dimethylamino-3,6-dimethyl-1,4-benzoquinone and in the same layer or in an adjacent layer,
(b) silver behenate,
(c) an activator-toning agent comprising phthalimide or phthalazinone,
(d) a phenolic reducing agent for said silver behenate, and
(e) a polymeric binder for said layer.

25. A non-silver halide photothermographic composition comprising
(a) a radiation sensitive quinone compound represented by the formula

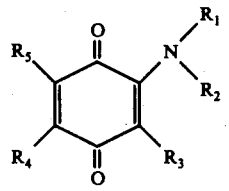

wherein
when $R_2$ is alkyl or aralkyl, $R_1$ is alkyl containing 1 to 10 carbon atoms, aralkyl containing 6 to 12 carbon atoms, or aryl containing 6 to 12 carbon atoms;
when $R_2$ is aryl, $R_1$ is alkyl containing 1 to 10 carbon atoms or alkaryl containing 6 to 12 carbon atoms;
$R_2$ is alkyl containing 1 to 10 carbon atoms, aryl containing 6 to 12 carbon atoms, or aralkyl containing 6 to 12 carbon atoms;
$R_1$ and $R_2$ can, taken together, comprise the atoms necessary to form a heterocyclic ring;
$R_3$ and $R_5$ are independently selected from the group consisting of hydrogen, aryl containing 6 to 12 carbon atoms, alkyl containing 1 to 10 carbon atoms, halogen, or alkoxy containing 1 to 6 carbon atoms;
$R_4$ is hydrogen, $NHR_2$,

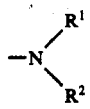

halogen, alkyl containing 1 to 10 carbon atoms, aryl containing 6 to 12 carbon atoms and alkoxy containing 1 to 6 carbon atoms wherein $R^1$ and $R^2$ are as defined; and
$R_4$ and $R_5$ can, taken together, comprise the atoms necessary to complete a carbocyclic ring;
(b) a silver salt of a long chain fatty acid,
(c) a polymeric binder for said layer, and
(d) a non-radiation sensitive reducing agent for said silver behenate.

26. A non-silver halide photothermographic composition as in claim 25 wherein said quinone compound is a compound selected from the group consisting of 2-chloro-3-dimethylamino-1,4-naphthoquinone; 2-dimethylamino-3,6-dimethyl-5-methylamino-1,4-benzoquinone; 2,5-dimethyl-3,6-bispyrrolidino-1,4-benzoquinone; 2,5-dimethylamino-1,4-benzoquinone; 2,5-diethylamino-1,4-benzoquinone and combinations thereof.

27. A non-silver halide photothermographic composition as in claim 25 wherein said silver salt comprises silver behenate.

28. A non-silver halide photothermographic composition as in claim 25 also comprising an activator-toning agent.

29. A non-silver halide photothermographic composition as in claim 25 also comprising an activator-toning agent comprising phthalimide, succinimide or 1-(2H)-phthalazinone.

30. A non-silver halide photothermographic composition as in claim 25 wherein said non-radiation sensitive reducing agent is a bis-beta naphthol.

31. A non-silver halide photothermographic composition comprising (a) 2,5-dimethylamino-3,6-dimethyl-1,4-benzoquinone,
(b) silver behenate,
(c) an activator-toning agent which is phthalimide or phthalazinone, and
(d) a non-radiation sensitive reducing agent for said silver behenate.

32. A process of developing a latent image in a non-silver halide photothermographic element comprising a support having thereon a layer comprising a radiation sensitive organic compound composition comprising (a) a radiation sensitive quinone compound represented by the formula:

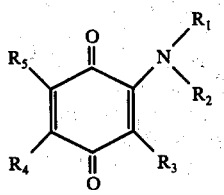

wherein when $R_2$ is alkyl or aralkyl, $R_1$ is alkyl containing 1 to 10 carbon atoms, aralkyl containing 6 to 12 carbon atoms, or aryl containing 6 to 12 carbon atoms;

when $R_2$ is aryl, $R_1$ is alkyl containing 1 to 10 carbon atoms or alkaryl containing 6 to 12 carbon atoms;

$R_2$ is alkyl containing 1 to 10 carbon atoms, aryl containing 6 to 12 carbon atoms, or aralkyl containing 6 to 12 carbon atoms;

$R_1$ and $R_2$ can, taken together, comprise the atoms necessary to complete a heterocyclic ring;

$R_3$ and $R_5$ are independently selected from the group consisting of hydrogen, aryl containing 6 to 12 carbon atoms, alkyl containing 1 to 10 carbon atoms, halogen, or alkoxy containing 1 to 6 carbon atoms;

$R_4$ is hydrogen, $NHR_2$,

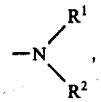

halogen, alkyl containing 1 to 10 carbon atoms, aryl containing 6 to 12 carbon atoms, and alkoxy containing 1 to 6 carbon atoms wherein $R^1$ and $R^2$ are as defined; and $R_4$ and $R_5$ can, taken together, comprise the atoms necessary to form a carbocyclic ring;

(b) a silver salt of a long chain fatty acid,
(c) a polymeric binder for said layer, and
(d) a non-radiation sensitive reducing agent for said silver behenate comprising overall heating said element to a temperature within the range of about 80° C to about 250° C.

33. A process as in claim 32 comprising overall heating said element to a temperature within the range of about 80° C to about 250° C for about 0.5 seconds to about 60 seconds.

34. A process as in claim 32 wherein said non-radiation sensitive reducing agent is a bis-beta-naphthol.

35. A non-silver halide photothermographic element as in claim 1 wherein said dye (1) is a compound selected from the group consisting of 4-(2,4-dinitrobenzylidene)-1-ethyl-1,4-dihydroquinoline; 4-(2,4-dinitrobenzylidene)-1,4-dihydro-1-phenacylquinoline; 4-(4-ethoxycarbonyl-2-nitrobenzylidene)-1-ethyl-1,4-dihydroquinoline; and combinations thereof.

36. A process of developing a latent image in a non-silver halide photothermographic element comprising a support having thereon a layer comprising (a) 2,5-dimethylamino-3,6-dimethyl-1,4-benzoquinone,
(b) silver behenate,
(c) an activator-toning agent which is phthalimide, succinimide or phthalazinone, and
(d) a non-radiation sensitive reducing agent for said silver behenate, comprising overall heating said element to a temperature within the range of about 80° C to about 250° C.

37. A non-silver halide photothermographic element comprising a support having thereon a layer comprising a radiation sensitive organic compound composition comprising (a) a combination of
  (1) 4-(2,4-dinitrobenzylidene)-1-ethyl-1,4-dihydroquinoline, with
  (2) 2,5-dimethylamino-3,6-dimethyl-1,4-benzoquinone,
(b) silver behenate,
(c) an activator-toning agent comprising phthalimide or phthalazinone,
(d) a non-radiation sensitive organic reducing agent for said silver behenate, and
(e) a poly(vinyl butyral) binder for said layer.

38. A process of developing a latent image in a non-silver halide photothermographic element comprising a support having thereon a layer comprising a radiation sensitive organic compound composition comprising (1) a radiation sensitive dye represented by the formula:

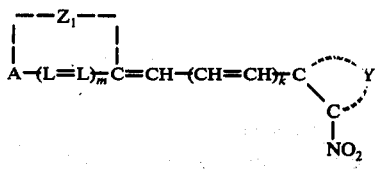

wherein:

(a) $k$ represents 0 or 1;

(b) $m$ represents 0 or 1;

(c) each L represents a methine group;

(d) A represents oxygen, sulphur or N-$R_1$;

(e) $R_1$ represents alkyl, alkenyl or aryl;

(f) $Z_1$ represents the nonmetallic atoms necessary to complete a basic, cyanine dye type heterocyclic nucleus forming a 5- or 6-membered heterocyclic ring whose skeletal atoms consist of the oxygen, sulfur or nitrogen atom of A, carbon atoms and one other atom chosen from the group consisting of carbon, oxygen, nitrogen, selenium and sulfur atoms, and (g) Y represents the atoms necessary to complete a nitro-substituted phenyl or naphthyl group or a carbonyl-substituted phenyl or naphthyl group; with (2) a radiation sensitive quinone compound represented by the formula:

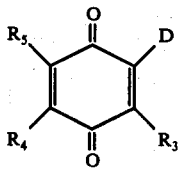

wherein

D is alkyl or

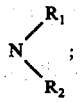

when $R_2$ is alkyl or aralkyl, $R_1$ is alkyl containing 1 to 10 carbon atoms, aralkyl containing 6 to 12 carbon atoms, or aryl containing 6 to 12 I carbon atoms;

when $R_2$ is aryl, $R_1$ is alkyl containing 1 to 10 carbon atoms or alkaryl containing 6 to 12 carbon atoms;

$R_2$ is alkyl containing 1 to 10 carbon atoms, aryl containing 6 to 12 carbon atoms, or aralkyl containing 6 to 12 carbon atoms;

$R_1$ and $R_2$ can, taken together, comprise the atoms necessary to complete a heterocyclic ring;

$R_3$ and $R_5$ are independently selected from the group consisting of hydrogen, aryl containing 6 to 12 carbon atoms, alkyl containing 1 to 10 carbon atoms, halogen, or alkoxy containing 1 to 6 carbon atoms;

$R_4$ is hydrogen, $NHR_2$

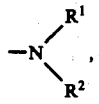

halogen, alkyl containing from 1 to 10 carbon atoms, aryl containing from 6 to 12 carbon atoms, and alkoxy containing from 1 to 6 carbon atoms wherein $R^1$ and $R^2$ are as defined; and $R_4$ and $R_5$ can, taken together, comprise the atoms necessary to form a carbocyclic ring;

and, in the same layer or in an adjacent layer, (a) a non-radiation sensitive reducing agent, (b) a silver salt of a long chain fatty acid, and (c) a polymeric binder for said layer;

comprising overall heating of said element to a temperature within the range of about 80° C to about 250° C.

39. A process as in claim 38 comprising overall heating said element to a temperature within the range of about 80° C to about 250° C for about 0.5 to about 60 seconds.

* * * * *

UNITED STATES PATENT AND TRADEMARK OFFICE

CERTIFICATE OF CORRECTION

PATENT NO. : 4,081,279

DATED : March 28, 1978

INVENTOR(S) : Charles A. Goffe (deceased), Donald W. Heseltine and Robert E. Bernard It is certified that error appears in the above-identified patent and that said Letters Patent are hereby corrected as shown below:

Column 2, line 16, after "a" insert --- non-silver halide ---; line 18, after "a" delete "non-silver halide".

Column 7, line 30, the formula

" 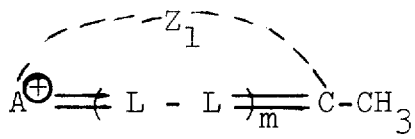 " should read

--- 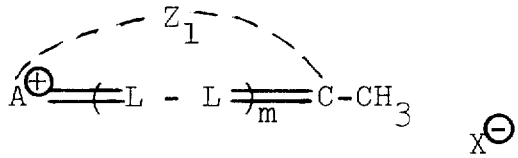 ---.

Column 8, line 60, after the formula insert ---and---.

Column 19, line 65, after "phenyl" insert ---or---.

Column 20, line 39, after "$R_1$" insert ---is---.

UNITED STATES PATENT AND TRADEMARK OFFICE

CERTIFICATE OF CORRECTION

PATENT NO. : 4,081,279

DATED : March 28, 1978

INVENTOR(S) : Charles A. Goffe (deceased), Donald W. Heseltine and Robert E. Bernard It is certified that error appears in the above-identified patent and that said Letters Patent are hereby corrected as shown below Column 23, line 59, "2,5-dimethyl-3,6-bispyrrolidino-1,4benzoquinone" should read --- 2,5-dimethyl-3,6-bispyrrolidino-1,4-benzoquinone ---.

Column 27, line 15, "sulphur" should read ---sulfur---.

Column 28, line 9, after "12" delete "1".

Signed and Sealed this

*Seventeenth* Day of *October 1978*

[SEAL]

*Attest:*

RUTH C. MASON
*Attesting Officer*

DONALD W. BANNER
*Commissioner of Patents and Trademarks*